US009881540B2

(12) United States Patent
Lee et al.

(10) Patent No.: US 9,881,540 B2
(45) Date of Patent: Jan. 30, 2018

(54) GATE DRIVER AND A DISPLAY APPARATUS HAVING THE SAME

(71) Applicant: SAMSUNG DISPLAY CO., LTD., Yongin-si, Gyeonggi-do (KR)

(72) Inventors: Hyoung-Rae Lee, Asan-si (KR); Moon-Ju Kim, Asan-si (KR); Eun-Suk Kim, Asan-si (KR); Seok-Kun Yoon, Yongin-si (KR); Kwang-Youl Lee, Asan-si (KR); Young-Min Choi, Hwaseong-si (KR); Jong-Won Choo, Seongnam-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/189,757

(22) Filed: Jun. 22, 2016

(65) Prior Publication Data

US 2017/0011679 A1 Jan. 12, 2017

(30) Foreign Application Priority Data

Jul. 8, 2015 (KR) ..... 10-2015-0097303

(51) Int. Cl.

| | |
|---|---|
| ***G09G 5/10*** | (2006.01) |
| ***G09G 3/20*** | (2006.01) |
| ***G09G 3/36*** | (2006.01) |

(52) U.S. Cl.

CPC ..... *G09G 3/2003* (2013.01); *G09G 3/3685* (2013.01); *G09G 3/3696* (2013.01); *G09G 2310/0213* (2013.01); *G09G 2310/0251* (2013.01); *G09G 2310/0267* (2013.01); *G09G 2310/0286* (2013.01); *G09G 2310/0291* (2013.01); *G09G 2310/08* (2013.01); *G09G 2320/0673* (2013.01)

(58) Field of Classification Search

CPC ... G09G 2310/0213; G09G 2310/0251; G09G 2310/0267; G09G 2310/0286; G09G 2310/0291; G09G 2310/08; G09G 2320/0673; G09G 3/2003; G09G 3/3685; G09G 3/3696

See application file for complete search history.

(56) References Cited

U.S. PATENT DOCUMENTS

2009/0058844 A1* 3/2009 Takada ..... G09G 3/3648 345/213
2015/0015564 A1* 1/2015 Yamagishi ..... G09G 3/3677 345/212

* cited by examiner

*Primary Examiner* — Insa Sadio
(74) *Attorney, Agent, or Firm* — F. Chau & Associates, LLC

(57) ABSTRACT

A gate driver includes first and second shift registers and a selector. The first shift register outputs first pulses. The second shift register outputs second pulses different from the first pulses. The selector selects one of the first pulses or the second pulses. When the selector selects the first pulses, the gate driver generates a first gate signal including first and second high periods, and output the first gate signal to a first gate line. The second high period is apart from the first high period by a first interval. When the selector selects the second pulses, the gate driver generates a second gate signal including the first high period and a third high period, and output the second gate signal to the first gate line. The third high period is apart from the first high period by a second interval different from the first interval.

20 Claims, 14 Drawing Sheets

GATE DRIVER AND A DISPLAY APPARATUS HAVING THE SAME

CROSS-REFERENCE TO RELATED APPLICATION

This application claims priority under 35 U.S.C. § 119 to Korean Patent Application No. 10-2015-0097303, filed on Jul. 8, 2015, in the Korean Intellectual Property Office (KIPO), the disclosure of which is incorporated by reference herein in its entirety.

TECHNICAL FIELD

Exemplary embodiments of the present inventive concept relate to a display device, and more particularly, to a gate driver and a display apparatus including the gate driver.

DISCUSSION OF THE RELATED ART

A display apparatus includes a display panel and a panel driver. The display panel includes a plurality of gate lines, a plurality of data lines, and a plurality of pixels, each of which is connected to one of the gate lines and one the data lines. The panel driver includes a gate driver providing gate signals to the gate lines and a data driver providing data voltages to the data lines.

To increase a charging rate of the pixel, a pre-charge driving method may be used. In the pre-charge driving method, an N-th gate line may be activated for being pre-charged before an N-th horizontal period.

SUMMARY

According to an exemplary embodiment of the present inventive concept, a gate driver is provided. The gate driver includes a first shift register, a second shift register, and a selector. The first shift register is configured to output a plurality of first pulses. The second shift register is configured to output a plurality of second pulses different from the plurality of first pulses. The selector is configured to select one of the plurality of first pulses or the plurality of second pulses. When the selector selects the first pulses, the gate driver is configured to generate a first gate signal including a first high period and a second high period, and to output the first gate signal to a first gate line. The second high period is apart from the first high period by a first interval. When the selector selects the second pulses, the gate driver is configured to generate a second gate signal including the first high period and a third high period, and to output the second gate signal to the first gate line. The third high period is apart from the first high period by a second interval different from the first interval.

The first shift register may be configured to generate the first pulses based on a gate clock signal and a first vertical start signal. The second shift register may be configured to generate the second pulses based on the gate clock signal and a second vertical start signal different from the first vertical start signal.

The first vertical start signal may have high levels at a first transition time of the gate clock signal and a second transition time of the gate clock signal. The second vertical start signal may have the high levels at the first transition time of the gate clock signal and a third transition time of the gate clock signal.

The first and second transition times may be adjacent to each other.

The second and third transition times may be adjacent to each other.

The gate driver may include a level shifter and a buffer. The level shifter may be configured to amplify the selected first pulses or second pulses. The buffer may be configured to buffer the amplified first pulses to generate the first gate signal, or to buffer the amplified second pulses to generate the second gate signal.

The first shift register may be configured to further output a plurality of third pulses. The second shift register may be configured to further output a plurality of fourth pulses different from the plurality of third pulses. The selector may be configured to further select one of the plurality of third pulses or the plurality of fourth pulses. When the selector selects the third pulses, the gate driver is configured to further generate a third gate signal including a fourth high period and a fifth high period, and to output the third gate signal to a second gate line. The fifth high period may be apart from the fourth high period by the first interval. When the selector selects the fourth pulses, the gate driver may be configured to further generate a fourth gate signal including the fourth high period and a sixth high period, and to output the fourth gate signal to the second gate line. The sixth high period may be apart from the fourth high period by the second interval.

The gate driver may further include a third shift register configured to output a plurality of third pulses. The plurality of third pulses may be different from each of the plurality of first pulses and the plurality of second pulses. The selector is configured to select one of the plurality of first pulses, the plurality of second pulses, or the plurality of third pulses. When the selector selects the third pulses, the gate driver is configured to generate a third gate signal including the first high period and a fourth high period, and to output the third gate signal to the first gate line. The fourth high period may be apart from the first high period by a third interval different from each of the first and second intervals.

According to an exemplary embodiment of the present inventive concept, a display apparatus is provided. The display apparatus includes a display panel, a timing controller, a gate driver, and a data driver. The display panel includes a first gate line. The timing controller is configured to generate a selection signal based on input image data. The gate driver includes a first shift register, a second shift register, and a selector. The first shift register is configured to output a plurality of first pulses. The second shift register is configured to output a plurality of second pulses different from the plurality of first pulses. The selector is configured to select one of the plurality of first pulses or the plurality of second pulses based on the selection signal. The data driver is configured to output a plurality of first data voltages corresponding to the first gate line. When the selector selects the first pulses, the gate driver is configured to generate a first gate signal including a first high period and a second high period, and to output the first gate signal to the first gate line. The second high period is apart from the first high period by a first interval in a first direction. When the selector selects the second pulses, the gate driver is configured to generate a second gate signal including the first high period and a third high period, and to output the second gate signal to the first gate line. The third high period is apart from the first high period by a second interval in the first direction. The second interval is different from the first interval.

The timing controller may be configured to further generate a gate clock signal, a first vertical start signal, and a second vertical start signal different from the first vertical start signal. The first shift register may be configured to generate the first pulses based on the gate clock signal and the first vertical start signal. The second shift register may be configured to generate the second pulses based on the gate clock signal and the second vertical start signal.

The first vertical start signal may have high levels at a first transition time of the gate clock signal and a second transition time of the gate clock signal. The second vertical start signal may have the high levels at the first transition time of the gate clock signal and a third transition time of the gate clock signal.

The first and second transition times may be adjacent to each other, and the second and third transition times may be adjacent to each other.

The display panel may further include second and third gate lines. The data driver may be configured to output the first data voltages corresponding to the first gate line, second data voltages corresponding to the second gate line, and third data voltages corresponding to the third gate line in an order of the third data voltages, the second voltages, and the first data voltages. The timing controller may be configured to compare first data corresponding to the first gate line with each of second data corresponding to the second gate line and third data corresponding to the third gate line, and to generate the selection signal.

When the first data is closer to the second data than to the third data, the selector may be configured to select the first pulses based on the selection signal. When the first data is closer to the third data than to the second data, the selector may be configured to select the second pulses based on the selection signal.

The first data voltages may be outputted during the first high period. When the first data is closer to the second data than to the third data and the selector selects the first pulses, the second data voltages may be outputted during the second high period and the third data voltages may be outputted during the third high period. The second interval may be two times the first interval.

The gate driver may further include a level shifter and a buffer. The level shifter may be configured to amplify the selected first pulses or second pulses. The buffer may be configured to buffer the amplified first pulses to generate the first gate signal, or buffer the amplified second pulses to generate the second gate signal.

The display panel may further include a second gate line. The first shift register may be configured to further output a plurality of third pulses. The second shift register may be configured to further output a plurality of fourth pulses different from the plurality of third pulses. The selector may be configured to further select one of the plurality of third pulses or the plurality of fourth pulses based on the selection signal. When the selector selects the third pulses, the gate driver may be configured to further generate a third gate signal including a fourth high period and a fifth high period, and to output the third gate signal to the second gate line. The fifth high period may be apart from the fourth high period by the first interval. When the selector selects the fourth pulses, the gate driver may be configured to further generate a fourth gate signal including the fourth high period and a sixth high period, and to output the fourth gate signal to the second gate line. The sixth high period may be apart from the fourth high period by the second interval.

The gate driver may further include a third shift register configured to output a plurality of third pulses. The plurality of third pulses may be different from each of the plurality of first pulses and the plurality of second pulses. The selector may be configured to select one of the plurality of first pulses, the plurality of second pulses, or the plurality of third pulses. When the selector selects the third pulses, the gate driver may be configured to generate a third gate signal including the first high period and a fourth high period, and to output the third gate signal to the first gate line. The fourth high period may be apart from the first high period by a third interval different from each of the first and second intervals.

According to an exemplary embodiment of the present inventive concept, a display apparatus is provided. The display apparatus includes a display panel, a timing controller, and a gate driver. The display panel includes a plurality of pixels arranged in a matrix form. Each of the pixels is connected to a respective one of gate lines and a respective one of data lines. The gate lines include first through third gate lines. The timing controller compares third data corresponding to the third gate line with each of first data corresponding to the first gate line and second data corresponding to the second gate line, and outputs a selection signal. The gate driver generates a plurality of first pulses based on a first vertical starting signal received from the timing controller and a plurality of second pulses based on a second vertical starting signal received from the timing controller, selects one of the plurality of first pulses or the plurality of second pulses based on the selection signal, and outputs first through third gate signals respectively corresponding to the first through third gate lines. The plurality of second pulses is different from the plurality of first pulses.

The first through third gate signals may be sequentially output to the first through third gate lines, respectively, in an order of the first through third gate signals. When the third data is closer to the second data than to the first data, the selector may select the first pulses based on the selection signal. When the third data is closer to the first data than to the second data, the selector may select the second pulses based on the selection signal.

BRIEF DESCRIPTION OF THE DRAWINGS

The above and other features of the present inventive concept will become more apparent by describing in detailed exemplary embodiments thereof with reference to the accompanying drawings, in which.

DETAILED DESCRIPTION OF EMBODIMENTS

Figure 1:
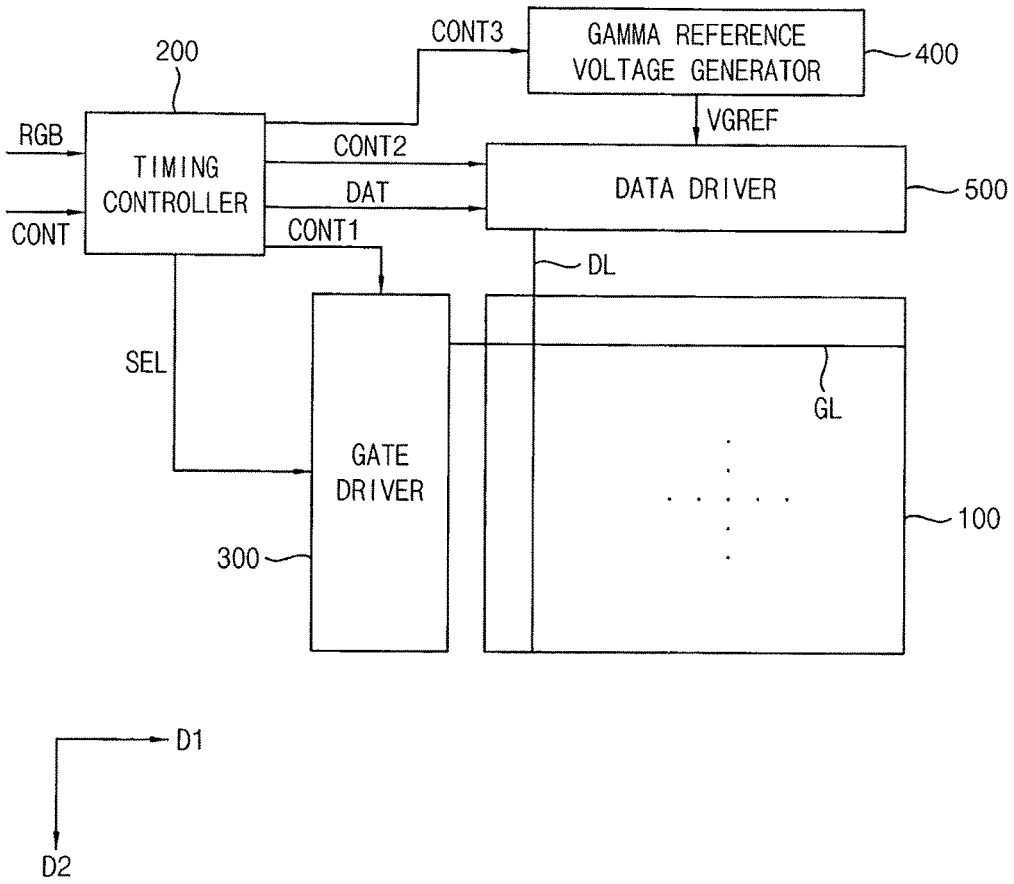
FIG. 1 is a block diagram illustrating a display apparatus according to an exemplary embodiment of the present inventive concept.

Hereinafter, the present inventive concept will be described in detail with reference to the accompanying drawings.

In the drawings, dimensions and sizes may be exaggerated for clarity of illustration. Like reference numerals refer to like elements throughout the specification and drawings. As used herein, the singular forms "a", "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region (e.g., a non-display region) adjacent to the display region.

The display panel 100 includes a plurality of gate lines GL, a plurality of data lines DL and a plurality of pixels, each of which is connected to one of the gate lines GL and one of the data lines DL. The gate lines GL extend in a first direction D1 and the data lines DL extend in a second direction D2 crossing the first direction D1.

In an exemplary embodiment of the present inventive concept, each of the pixels may include a switching element, a liquid crystal capacitor and a storage capacitor. The liquid crystal capacitor and the storage capacitor may be electrically connected to the switching element. The pixels may be arranged in a matrix configuration.

The display panel 100 will be described in detail with reference to FIGS. 5A, 5B, 6A, 6B, 7A and 7B.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, a data signal DAT and a selection signal SEL based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a first vertical start signal and a gate clock signal. The first control signal CONT1 may further include a second vertical start signal.

The vertical start signal (e.g., the first and second vertical start signals) will be described in detail with reference to FIGS. 4A through 4D.

The timing controller 200 generates the selection signal SEL for controlling operations of the gate driver 300 based on the input image data RGB. The timing controller 200 may compare data voltages respectively corresponding to the gate lines GL with each other to generate to the selection signal SEL. The timing controller 200 outputs the selection signal SEL to the gate driver 300.

The selection signal SEL will be described in detail with reference to FIGS. 2 and 3.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500.

The data signal DAT will be described in detail with reference to FIGS. 4A through 4D.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 and the selection signal SEL received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. In an exemplary embodiment of the present inventive concept, the gate driver 300 may be integrated on the peripheral region of the display panel 100.

The gate driver 300 will be described in detail with reference to FIGS. 2 and 3.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment of the present inventive concept, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a tape carrier package (TCP) type. In an exemplary embodiment of the present inventive concept, the data driver 500 may be integrated on the peripheral region of the display panel 100.

Figure 2:
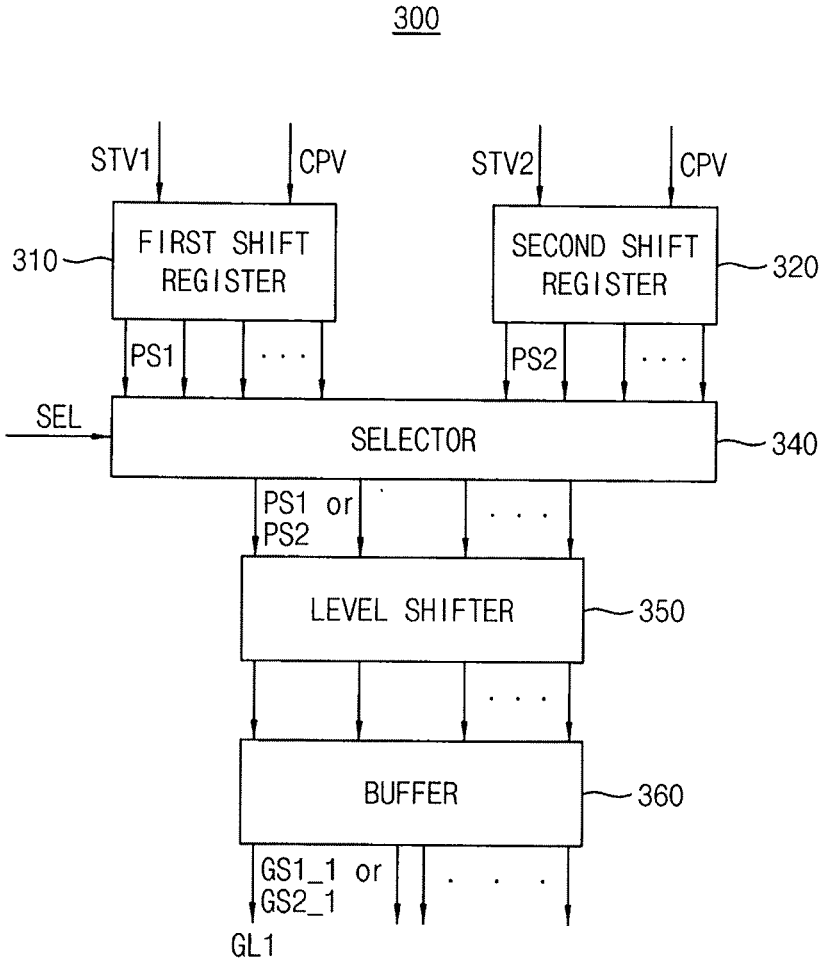
FIG. 2 is a block diagram illustrating a gate driver according to an exemplary embodiment of the present inventive concept.

FIG. 2 is a block diagram illustrating a gate driver 300 according to an exemplary embodiment of the present inventive concept.

Referring to FIGS. 1 and 2, the gate driver 300 includes a first shift register 310, a second shift register 320 and a selector 340. The gate driver 300 may further include a level shifter 350 and a buffer 360.

The first shift register 310 receives the first control signal CONT1 from the timing controller 200. The first control signal CONT1 may include a first vertical start signal STV1 and a gate clock signal CPV. The first shift register 310 may generate first pulses PS1 based on the first vertical start signal STV1 and the gate clock signal CPV. The first pulses PS1 may correspond to a first gate line GL1. The first shift register 310 outputs the first pulses PS1 to the selector 340.

The second shift register 320 receives the first control signal CONT1 from the timing controller 200. The first control signal CONT1 may include a second vertical start signal STV2 and the gate clock signal CPV. The second vertical start signal STV2 may be different from the first vertical start signal STV1. The second shift register 320 may generate a plurality of second pulses PS2 based on the second vertical start signal STV2 and the gate clock signal CPV. The second pulses PS2 may be different from the first pulses PS1. The second pulses PS2 may correspond to the first gate line GL1. The second shift register 320 outputs the second pulses PS2 to the selector 340.

The first and second shift registers 310 and 320 will be described in detail with reference to FIGS. 4A through 4D.

The selector 340 receives the selection signal SEL from the timing controller 200. The selector 340 receives the first pulses PS1 from the first shift register 310. The selector 340 receives the second pulses PS2 from the second shift register 320. The selector 340 selects one of the first pulses PS1 and the second pulses PS2 for the first gate line GL1 based on the selection signal SEL. The selector 340 may output the selected one (e.g., PS1 or PS2) of the first pulses PS1 and the second pulses PS2 to the level shifter 350.

The selector 340 will be described in detail with reference to FIG. 3.

The level shifter 350 may amplify levels of the selected pulses PS1 or PS2. The level shifter 350 may output the amplified pulses (e.g., PS1 or PS2) to the buffer 360.

The buffer 360 may buffer the amplified pulses. The buffer 360 may further amplify the amplified pulses by an expected amount of reduction of gate voltage due to delay. The buffer 360 may output a first gate signal GS1_1 or GS2_1 to the first gate line GL1.

Figure 3:
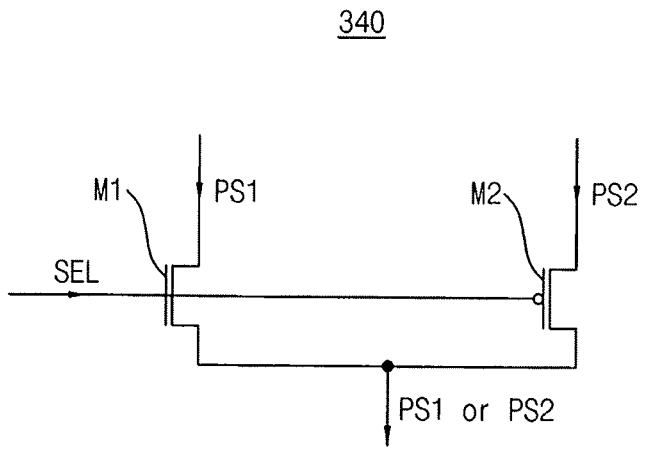
FIG. 3 is a circuit diagram illustrating a selector included in a gate driver according to an exemplary embodiment of the present inventive concept.

FIG. 3 is a circuit diagram illustrating a selector included in a gate driver according to an exemplary embodiment of the present inventive concept.

Referring to FIGS. 1 through 3, the selector 340 may include a first switching element M1 and a second switching element M2. For example, the first switching element M1 may be an N-channel metal-oxide-semiconductor field-effect transistor (MOSFET), and the second switching element M2 may be a P-channel MOSFET. In an exemplary embodiment of the present inventive concept, the first switching element M1 may be the P-channel MOSFET, and the second switching element M2 may be the N-channel MOSFET.

The first pulses PS1 may be applied to one end (e.g., a source electrode) of the first switching element M1. The second pulses PS2 may be applied to one end (e.g., a source electrode) of the second switching element M2. The selection signal SEL may be applied to a gate electrode of the first switching element M1 and a gate electrode of the second switching element M2.

In an exemplary embodiment of the present inventive concept, the first switching element M1 may be turned on and the second switching element M2 may be turned off based on the selection signal SEL. In this case, the selector 340 selects the first pulses PS1. For example, the selector 340 may output the selected first pulses PS1 through a drain electrode of the first switching element M1.

In an exemplary embodiment of the present inventive concept, the first switching element M1 may be turned off and the second switching element M2 may be turned on based on the selection signal SEL. In this case, the selector 340 selects the second pulses PS2. For example, the selector 340 may output the selected second pulses PS2 through a drain electrode of the second switching element M2.

Figure 4A:
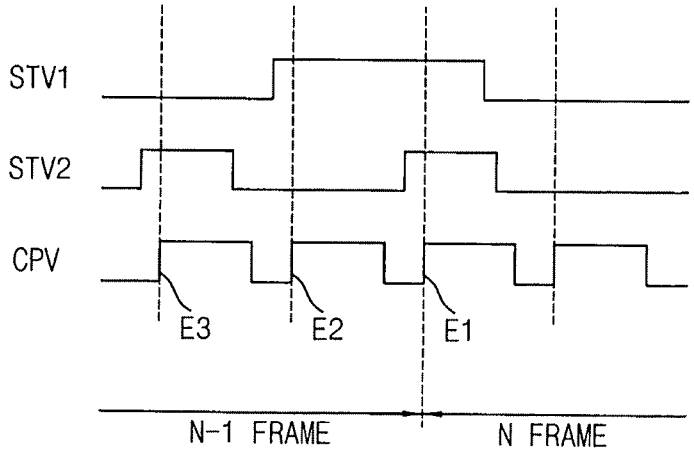
FIG. 4A is a diagram illustrating signals outputted to a gate driver according to an exemplary embodiment of the present inventive concept.

FIG. 4A is a diagram illustrating signals outputted to a gate driver according to an exemplary embodiment of the present inventive concept.

Referring to FIGS. 1, 2 and 4A, the timing controller 200 outputs the first control signal CONT1 to the gate driver 300. The first control signal CONT1 may include the first vertical start signal STV1, the second vertical start signal STV2 and the gate clock signal CPV. The second vertical start signal STV2 may be different from the first vertical start signal STV1. The gate clock signal CPV may have a first transition time E1, a second transition time E2 and a third transition time E3.

The first vertical start signal STV1 may have a high level at the first and second transition times E1 and E2 of the gate clock signal CPV. The second vertical start signal STV2 may have the high level at the first and third transition times E1 and E3 of the gate clock signal CPV. The first and second transition times E1 and E2 may be adjacent to each other. The second and third transition times E2 and E3 may be adjacent to each other. For example, the first through third transition times E1 through E3 may be arranged in a sequential manner. Each of an interval between the first and second transition times E1 and E2 and an interval between the second and third transition times E2 and E3 may correspond to a single horizontal period.

Figure 4B:
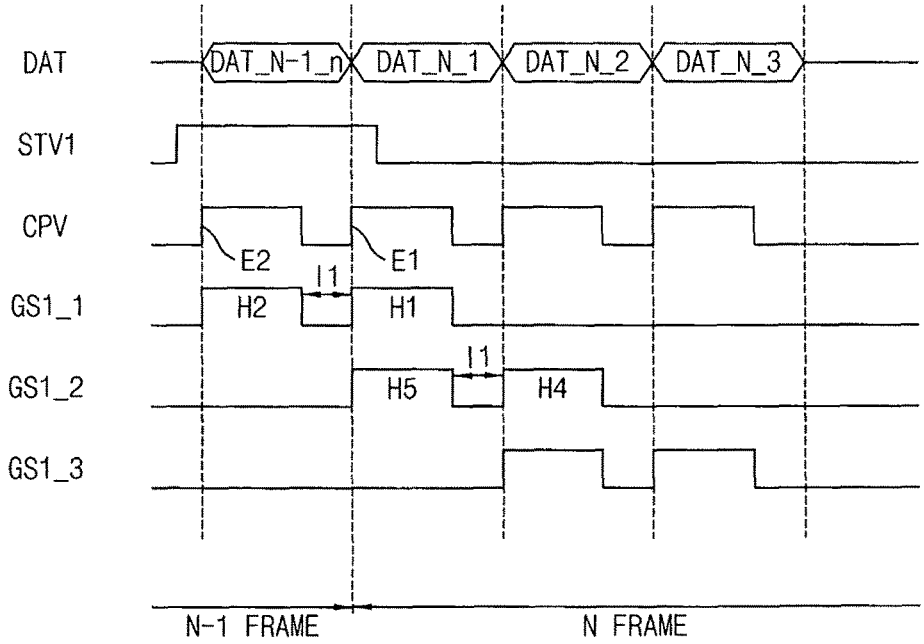
FIG. 4B is a diagram illustrating signals when a selector included in a gate driver, according to an exemplary embodiment of the present inventive concept, selects pulses output from a second shift register.

FIG. 4B is a diagram illustrating signals when a selector included in a gate driver, according to an exemplary embodiment of the present inventive concept, selects pulses output from a second shift register.

Referring to FIGS. 1, 2, 4A and 4B, the selector 340 selects the first pulses PS1 for the first gate line GL1 based on the selection signal SEL. The first pulses PS1 may be generated based on the first vertical start signal STV1 and the gate clock signal CPV. The first vertical start signal STV1 may have the high level at the first and second transition times E1 and E2 of the gate clock signal CPV. The first and second transition times E1 and E2 may be adjacent to each other.

The gate driver 300 generates a first gate signal GS1_1 corresponding to the first gate line GL1. The first gate signal GS1_1 has first and second high periods H1 and H2. The second high period H2 may be apart from the first high period H1 by a first interval I1. The first interval I1 may be zero. For example, the first interval I1 may correspond to a time between a rising edge of the first high period H1 and a falling edge of the second high period H2. For example, a rising edge of the rising edge of the first high period H1 and a rising edge of the second high period H2 may correspond to a single horizontal period. Data voltages DAT_N_1 corresponding to the first gate line GL1 in an N-th frame may be outputted during the first high period H1. Data voltages DAT_N−1_n corresponding to an n-th gate line in an (N−1)-th frame may be outputted during the second high period H2.

The display panel 100 may further include a second gate line GL2. The first shift register 310 may further output a plurality of third pulses PS3. The second shift register 320 may further output a plurality of fourth pulses PS4. The fourth pulses PS4 may be different from the third pulses PS3. The third and fourth pulses PS3 and PS4 may correspond to the second gate line GL2. The selector 340 may select one of the third pulses PS3 and the fourth pulses PS4 for the second gate line GL2.

The selector 340 may select the third pulses PS3 for the second gate line GL2 based on the selection signal SEL. The third pulses PS3 may be generated based on the first vertical start signal STV1 and the gate clock signal CPV.

The gate driver 300 may generate a second gate signal GS1_2 corresponding to the second gate line GL2. The second gate signal GS1_2 may have fourth and fifth high periods H4 and H5. The fifth high period H5 may be apart from the fourth high period H4 by the first interval I1. For example, the first interval I1 may correspond to a time between a rising edge of the fourth high period H4 and a falling edge of the fifth high period H5. For example, the rising edge of the fourth high period H4 and a rising edge of the fifth high period H5 may correspond to a single horizontal period. The first interval I1 may be zero. Data voltages DAT_N_2 corresponding to the second gate line GL2 in the N-th frame may be outputted during the fourth high period H4. The data voltages DAT_N_1 corresponding to the first gate line GL1 in the N-th frame may be outputted during the fifth high period H5.

The display panel 100 may further include a third gate line GL3. The first shift register 310 may further output a plurality of fifth pulses PS5. The second shift register 320 may further output a plurality of sixth pulses PS6. The fifth pulses PS5 may be different from the sixth pulses PS6. The fifth and sixth pulses PS5 and PS6 may correspond to the third gate line GL3. The selector 340 may select one of the fifth pulses PS5 and the sixth pulses PS6 for the third gate line GL3.

The selector 340 may select the fifth pulses PS5 for the third gate line GL3 based on the selection signal SEL. The fifth pulses PS5 may be generated based on the first vertical start signal STV1 and the gate clock signal CPV.

The gate driver 300 may generate a third gate signal GS1_3 corresponding to the third gate line GL3. The third gate signal GS1_3 may have seventh and eighth high periods H7 and H8. The seventh high period H7 may be apart from the eighth high period H8 by the first interval I1. A rising edge of the seventh high period H7 and a rising edge of the eighth high period H8 may correspond to a single horizontal period. Data voltages DAT_N_3 corresponding to the third gate line GL3 in the N-th frame may be outputted during the seventh high period H7. The data voltages DAT_N_2 corresponding to the second gate line GL2 in the N-th frame may be outputted during the eighth high period H8.

Figure 4C:
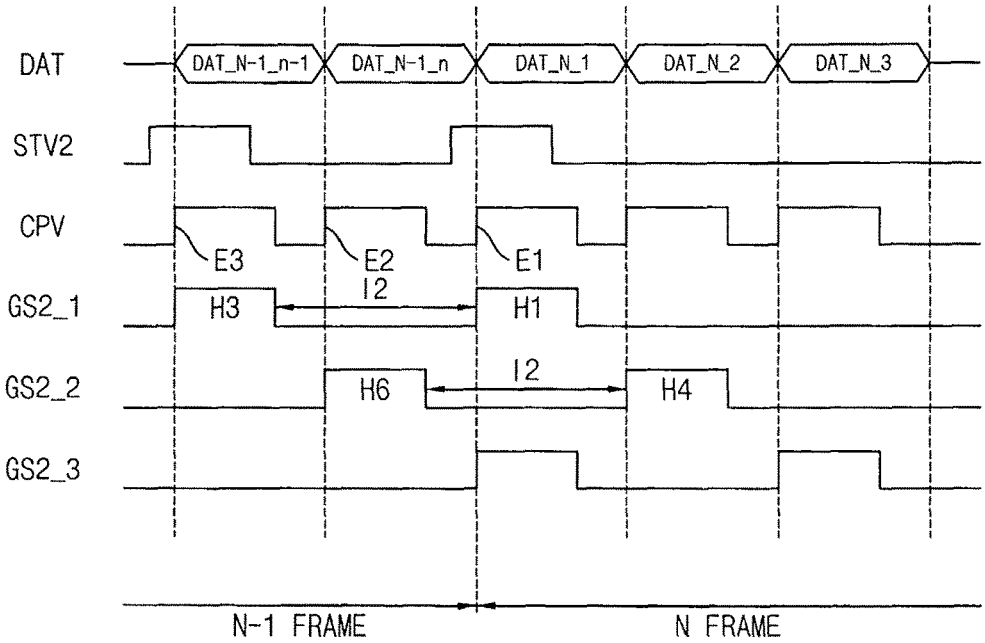
FIG. 4C is a diagram illustrating signals when a selector included in a gate driver, according to an exemplary embodiment of the present inventive concept, selects pulses output from a second shift register.

FIG. 4C is a diagram illustrating signals when a selector included in a gate driver, according to an exemplary embodiment of the present inventive concept, selects pulses output from a second shift register.

Referring to FIGS. 1, 2, 4A and 4C, the selector 340 selects the second pulses PS2 for the first gate line GL1 based on the selection signal SEL. The second pulses PS2 may be generated based on the second vertical start signal STV2 and the gate clock signal CPV. The second vertical start signal STV2 may have the high level at the first and third transition times E1 and E3 of the gate clock signal CPV. The second transition time E2 may be positioned between the first and third transition times E1 and E3.

The gate driver 300 generates a first gate signal GS2_1 corresponding to the first gate line GL1. The first gate signal GS2_1 has first and third high periods H1 and H3. The third high period H3 may be apart from the first high period H1 by a second interval I2. For example, the second interval I2 may correspond to a time between a rising edge of the first high period H1 and a falling edge of the third high period H3. The second interval I2 may be different from the first interval I1. The second interval I2 may be longer than the first interval I1 by a single horizontal period. For example, a rising edge of the first high period H1 and a rising edge of the third high period H3 may correspond to a single horizontal period. Data voltages DAT_N_1 corresponding to the first gate line GL1 in an N-th frame may be outputted during the first high period H1. Data voltages DAT_N−1_n−1 corresponding to an (n−1)-th gate line in an (N−1)-th frame may be outputted during the third high period H3.

The display panel 100 may further include the second gate line GL2. The selector 340 may select the fourth pulses PS4 for the second gate line GL2 based on the selection signal SEL. The fourth pulses PS3 may be generated based on the second vertical start signal STV2 and the gate clock signal CPV.

The gate driver 300 may generate a second gate signal GS2_2 corresponding to the second gate line GL2. The second gate signal GS2_2 may have fourth and sixth high periods H4 and H6. The sixth high period H6 may be apart from the fourth high period H4 by the second interval I2. For example, the second interval I2 may correspond to a time between a rising edge of the fourth high period H4 and a falling edge of the sixth high period H6. The second interval I2 may be different from the first interval I1. The second interval I2 may be longer than the first interval I1 by a single horizontal period. For example, a rising edge of the fourth high period H4 and a rising edge of the sixth high period H6 may correspond to two horizontal periods. Data voltages DAT_N_2 corresponding to the second gate line GL2 in the N-th frame may be outputted during the fourth high period H4. The data voltages DAT_N−1_n corresponding to an n-th gate line in the (N−1)-th frame may be outputted during the sixth high period H6.

The display panel 100 may further include the third gate line GL3. The selector 340 may select the sixth pulses PS6 for the third gate line GL3 based on the selection signal SEL. The sixth pulses PS6 may be generated based on the second vertical start signal STV2 and the gate clock signal CPV.

The gate driver 300 may generate a third gate signal GS2_3 corresponding to the third gate line GL3. The third gate signal GS2_3 may have seventh and ninth high periods H7 and H9. The seventh high period H7 may be apart from the eighth high period H9 by the second interval I2. For example, a rising edge of the seventh high period H7 and a rising edge of the ninth high period H9 may correspond to two horizontal periods. Data voltages DAT_N_3 corresponding to the third gate line GL3 in the N-th frame may be outputted during the seventh high period H7. The data voltages DAT_N_1 corresponding to the first gate line in the N-th frame may be outputted during the ninth high period H9.

Figure 4D:
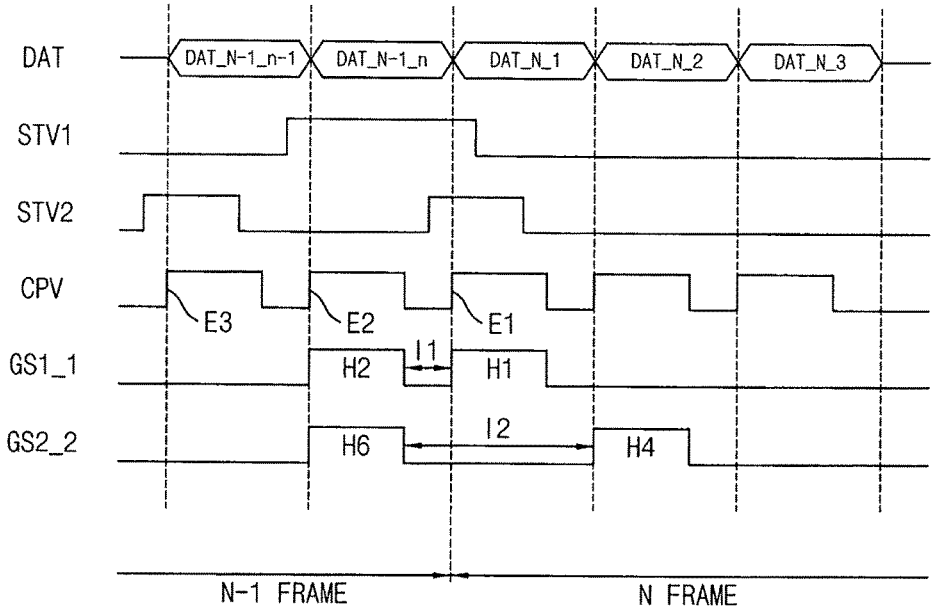
FIG. 4D is a diagram illustrating signals when a selector included in a gate driver, according to an exemplary embodiment of the present inventive concept, selects pulses output from a first shift register for one of adjacent gate lines and pulses output from a second shifter register for another one of the adjacent gate lines.

FIG. 4D is a diagram illustrating signals when a selector included in a gate driver, according to an exemplary embodiment of the present inventive concept, selects pulses output from a first shift register for one of adjacent gate lines and pulses output from a second shifter register for another one of the adjacent gate lines. Hereinafter, repetitive descriptions with respect to FIGS. 4B and 4C will be omitted.

Referring to FIGS. 1, 2 and 4A through 4D, the timing controller 200 may compare data DAT_N_1 corresponding to the first gate line GL1 in the N-th frame with data DAT_N−1_n−1 corresponding to the (n−1)-th gate line in the (N−1)-th frame and data DAT_N−1_n corresponding to the n-th gate line in the (N−1)-th frame.

When the data DAT_N_1 corresponding to the first gate line GL1 in the N-th frame is closer to the data DAT_N−1_n corresponding to the n-th gate line in the (N−1)-th frame than to the data DAT_N−1_n−1 corresponding to the (n−1)-th gate line in the (N−1)-th frame, the timing controller 200 may generate the selection signal SEL to select the first pulses PS1 output from the first shift register 310 for the first gate line GL1.

In an exemplary embodiment of the present inventive concept, when the data DAT_N_1 corresponding to the first gate line GL1 in the N-th frame is closer to the data DAT_N−1_n−1 corresponding to the (n−1)-th gate line in the (N−1)-th frame than to the data DAT_N−1_n corresponding to the n-th gate line in the (N−1)-th frame, the timing controller 200 may generate the selection signal SEL to select the second pulses PS2 output from the second shift register 320 for the first gate line GL1.

For example, the selector 340 may select the first pulses PS1 for the first gate line GL1 based on the selection signal SEL. The first pulses PS1 may be generated based on the first vertical start signal STV1 and the gate clock signal CPV.

The gate driver 300 may generate the first gate signal GS1_1 corresponding to the first gate line GL1. The first gate signal GS1_1 may have the first and second high periods H1 and H2. The second high period H2 may be apart from the first high period H1 by the first interval I1. For example, the second interval I2 may correspond to a time between a rising edge of the first high period H1 and a falling edge of the second high period H2. The first interval I1 may be zero. The data voltages DAT_N_1 corresponding to the first gate line GL1 in the N-th frame may be outputted during the first high period H1. The data voltages DAT_N−1_n corresponding to the n-th gate line in the (N−1)-th frame may be outputted during the second high period H2.

The timing controller 200 may compare data DAT_N_2 corresponding to the second gate line in the N-th frame with the data DAT_N−1_n corresponding to the n-th gate line in the (N−1)-th frame and the data DAT_N_1 corresponding to the first gate line GL1 in the N-th frame.

When the data DAT_N_2 corresponding to the second gate line GL2 in the N-th frame is closer to the data DAT_N−1_n corresponding to the n-th gate line in the (N−1)-th frame than to the data DAT_N_1 corresponding to the first gate line GL1 in the N-th frame, the timing controller 200 may generate the selection signal SEL to select the fourth pulses PS4 output from the second shift register 320 for the second gate line GL2.

In an exemplary embodiment of the present inventive concept, when the data DAT_N_2 corresponding to the second gate line in the N-th frame is closer to the data DAT_N_1 corresponding to the first gate line GL1 in the N-th frame than to the data DAT_N−1_n corresponding to the n-th gate line in the (N−1)-th frame, the timing controller 200 may generate the selection signal SEL to select the third pulses PS3 output from the first shift register 310 for the first gate line GL1.

The selector 340 may select the fourth pulses PS4 for the second gate line GL2 based on the selection signal SEL. The fourth pulses PS4 may be generated based on the second vertical start signal STV2 and the gate clock signal CPV.

The gate driver 300 may generate the second gate signal GS2_2 corresponding to the second gate line GL2. The second gate signal GS2_2 may have the fourth and sixth high periods H4 and H6. The sixth high period H6 may be apart from the fourth high period H4 by the second interval I2. For example, the second interval I2 may correspond to a time between a rising edge of the fourth high period H4 and a falling edge of the sixth high period H6. The second interval I2 may be different from the first interval I1. The second interval I2 may be longer than the first interval I1 by a single horizontal period. For example, a rising edge of the fourth high period H4 and a rising edge of the sixth high period H6 may correspond to two horizontal periods. The data voltages DAT_N_2 corresponding to the second gate line GL2 in the N-th frame may be outputted during the fourth high period H4. The data voltages DAT_N−1_n corresponding to the n-th gate line in the (N−1)-th frame may be outputted during the sixth high period H6.

Figure 5A:
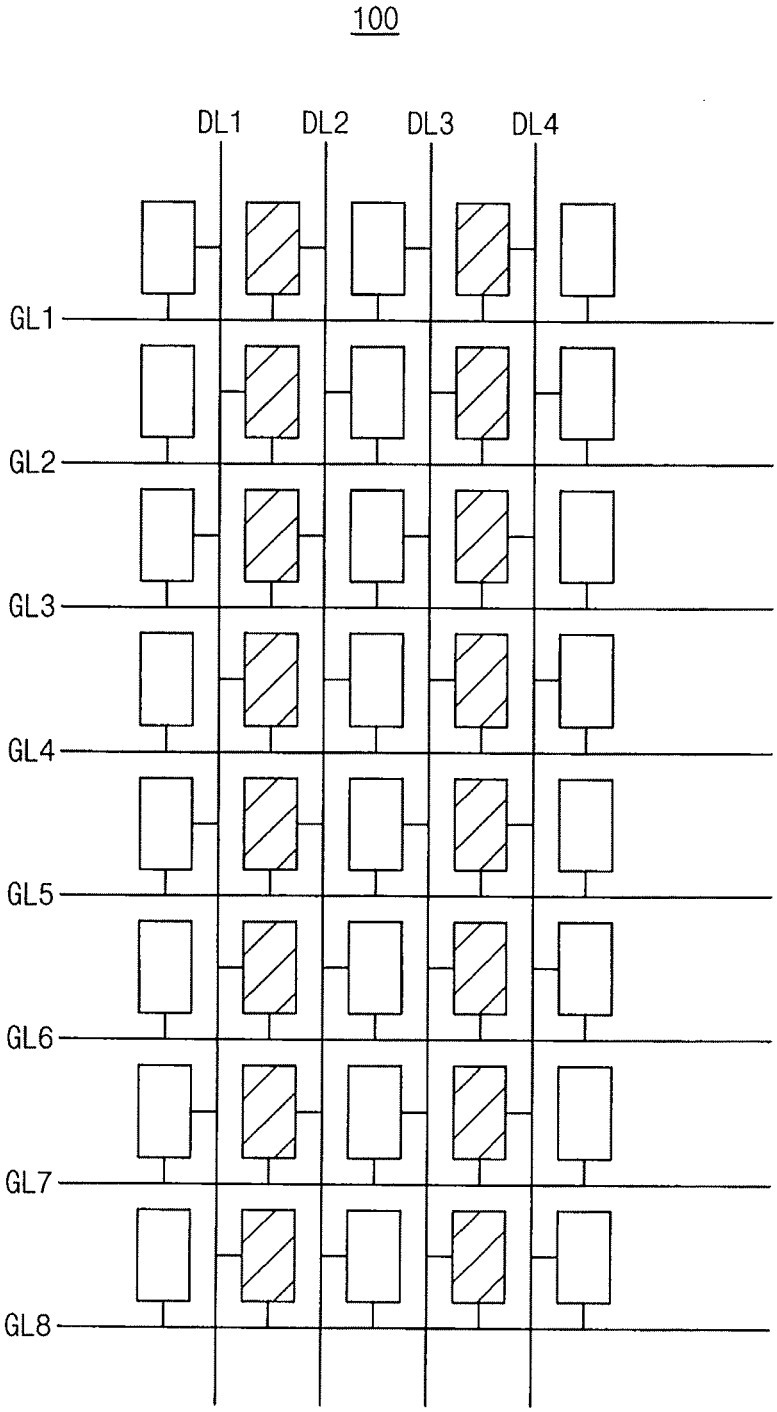
FIG. 5A is a diagram illustrating a first image pattern where pixels are not pre-charged.

FIG. 5A is a diagram illustrating a first image pattern where pixels are not pre-charged.

Referring to FIGS. 1 and 5A, the display panel 100 may include first through eighth gate lines GL1 through GL8, first through fourth data lines DL1 through DL4, and a plurality of pixels. The first through eighth gate lines GL1 through GL8 may extend in the first direction D1. The first through fourth data lines DL1 through DL4 may extend in the second direction D2 crossing the first direction D1. The first through eighth gate lines GL1 through GL8 may be arranged in an order of the first to eighth gate lines along the second direction D2. The first through fourth data lines DL1 through DL4 may be arranged in an order of the first to fourth data lines along the first direction D1. Each of the pixels may be connected to one of the first through eighth gate lines GL1 through GL8 and one of the first through fourth data lines DL1 through DL4. The pixels may be arranged in the matrix configuration.

A first image pattern includes first and second vertical lines. For example, the first and second vertical lines may correspond to second and fourth columns, respectively, in the matrix of FIG. 5A. Pixels corresponding to the first and second vertical lines have a first brightness value, when not pre-charged. Referring to FIG. 5A, the first brightness value may be represented by three slashes.

Figure 5B:
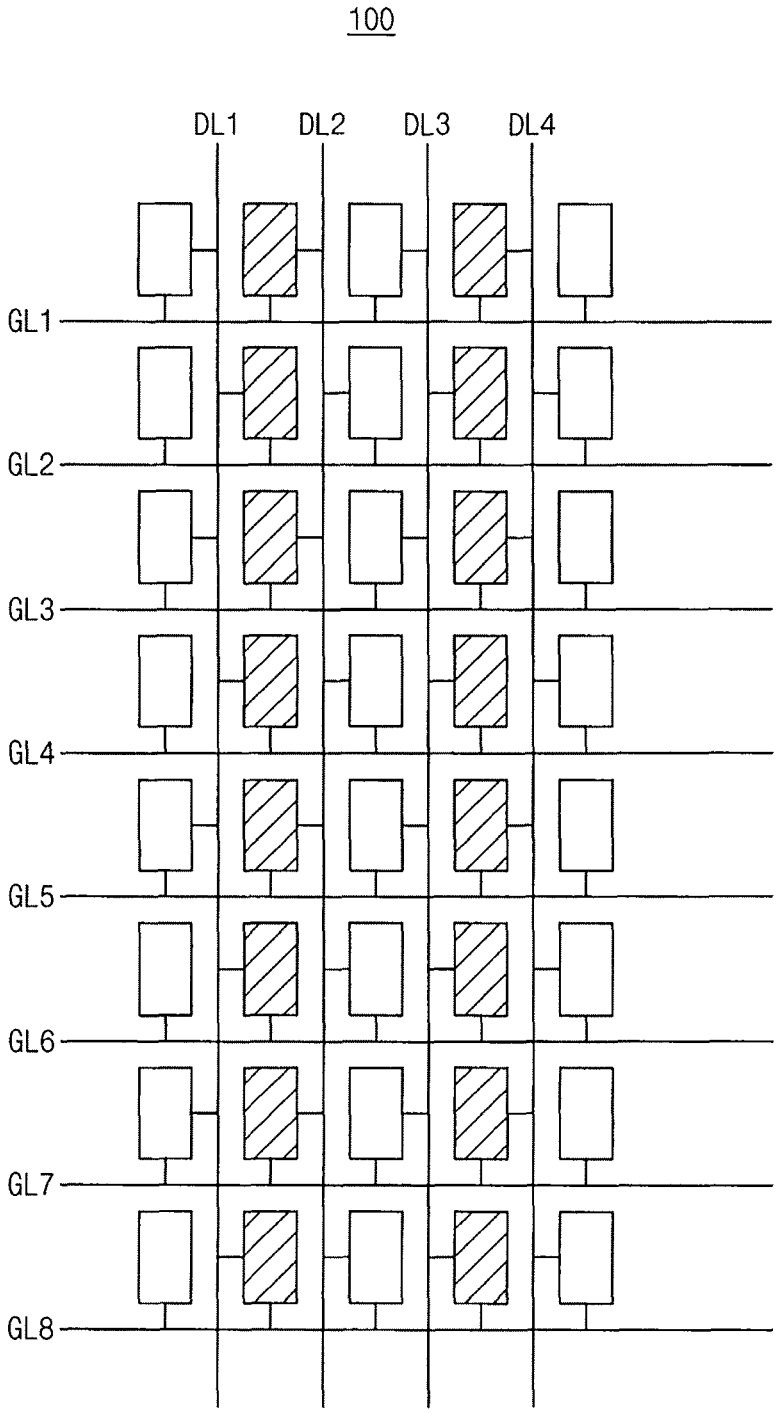
FIG. 5B is a diagram illustrating a first image pattern displayed on a display panel included in a display apparatus according to an exemplary embodiment of the present inventive concept.

FIG. 5B is a diagram illustrating a first image pattern displayed on a display panel included in a display apparatus according to an exemplary embodiment of the present inventive concept.

Referring to FIGS. 1, 2, 4C, 5A and 5B, the timing controller 200 may compare data corresponding to the third gate line GL3 with data corresponding to the first gate line GL1 and data corresponding to the second gate line GL2.

For example, among pixels connected to the first data line DL1, a pixel (e.g., a pixel in a third row and a first column of FIG. 7A) connected to the third gate line GL3 do not display an image, a pixel (e.g., a pixel in a second row and a second column of FIG. 7A) connected to the second gate line GL2 display the image, and a pixel (e.g., a pixel in a first row and a first column of FIG. 7A) connected to the first gate line GL1 do not display the image. For example, the data corresponding to the third gate line GL3 is closer to the data corresponding to the first gate line GL1 than to the data corresponding to the second gate line GL2.

The timing controller 200 may generate the selection signal SEL to select pulses outputted from the second shift register 320 for the third gate line GL3 based on the comparison.

The selector 340 may select pulses outputted from the second shift register 320 for the third gate line GL3 based on the selection signal SEL. The pulses outputted from the second shift register 320 may be generated based on the second vertical start signal STV2 and the gate clock signal CPV.

The gate driver 300 may generate a third gate signal based on the selected pulses. The third gate signal may have two high periods apart from each other by the second interval I2.

Substantially the same method may be applied to other gate lines.

Accordingly, pixels corresponding to the first and second vertical lines have a second brightness value. For example, the second brightness value may be greater than the first brightness value. Referring to FIG. 5B, the second brightness value may be represented by five slashes.

Figure 6A:
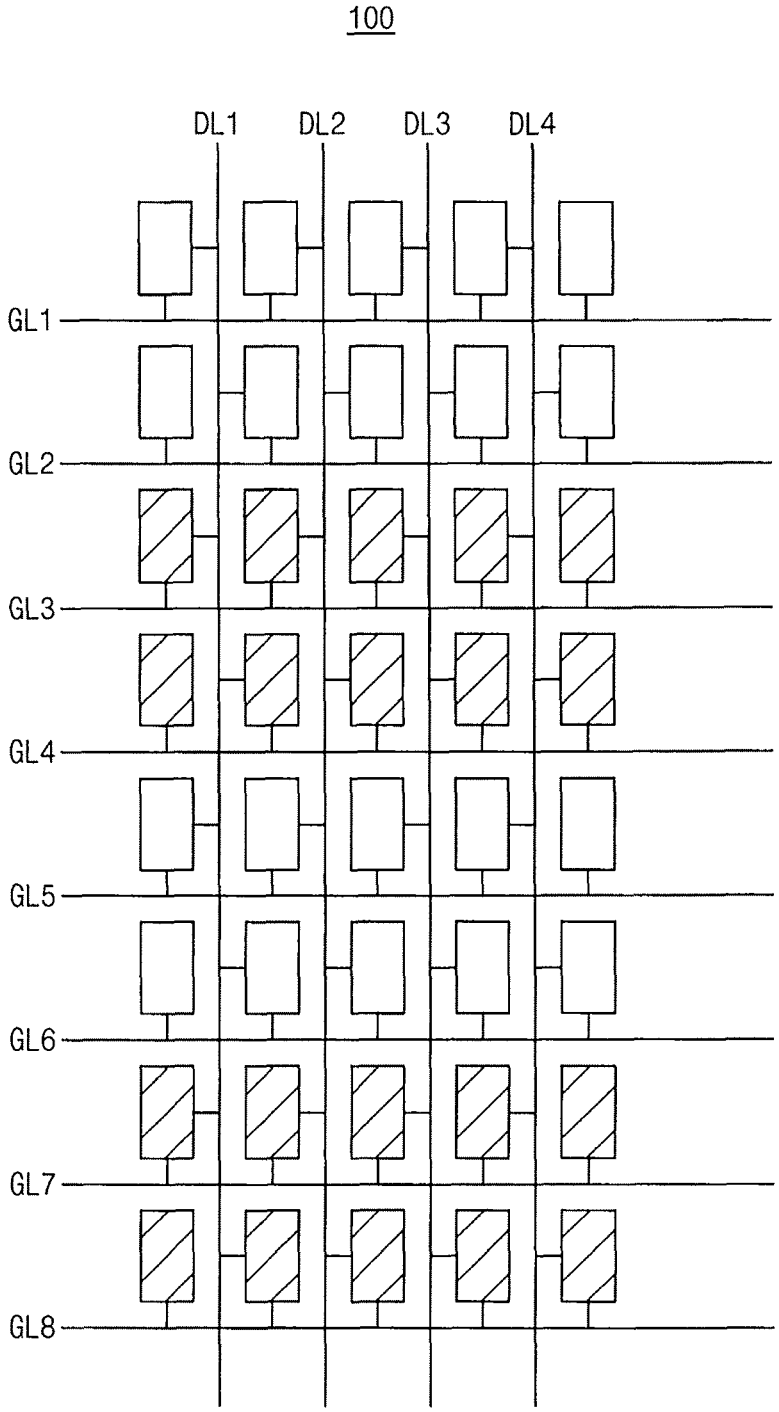
FIG. 6A is a diagram illustrating a second image pattern when pixels are not pre-charged.

FIG. 6A is a diagram illustrating a second image pattern when pixels are not pre-charged.

Referring to FIG. 6A, the second image pattern includes first and second horizontal lines. The first horizontal line may correspond to third and fourth rows in a pixel matrix of FIG. 6A. The second horizontal line may correspond to seventh and eighth rows in the pixel matrix of FIG. 6A. Pixels corresponding to the first and second horizontal lines have a third brightness value when not pre-charged. Referring to FIG. 6A, the third brightness value may be represented by three slashes. For example, the third brightness value may be the same as the first brightness value. In an exemplary embodiment of the present inventive concept, the third brightness value may be different from the first brightness value.

Figure 6B:
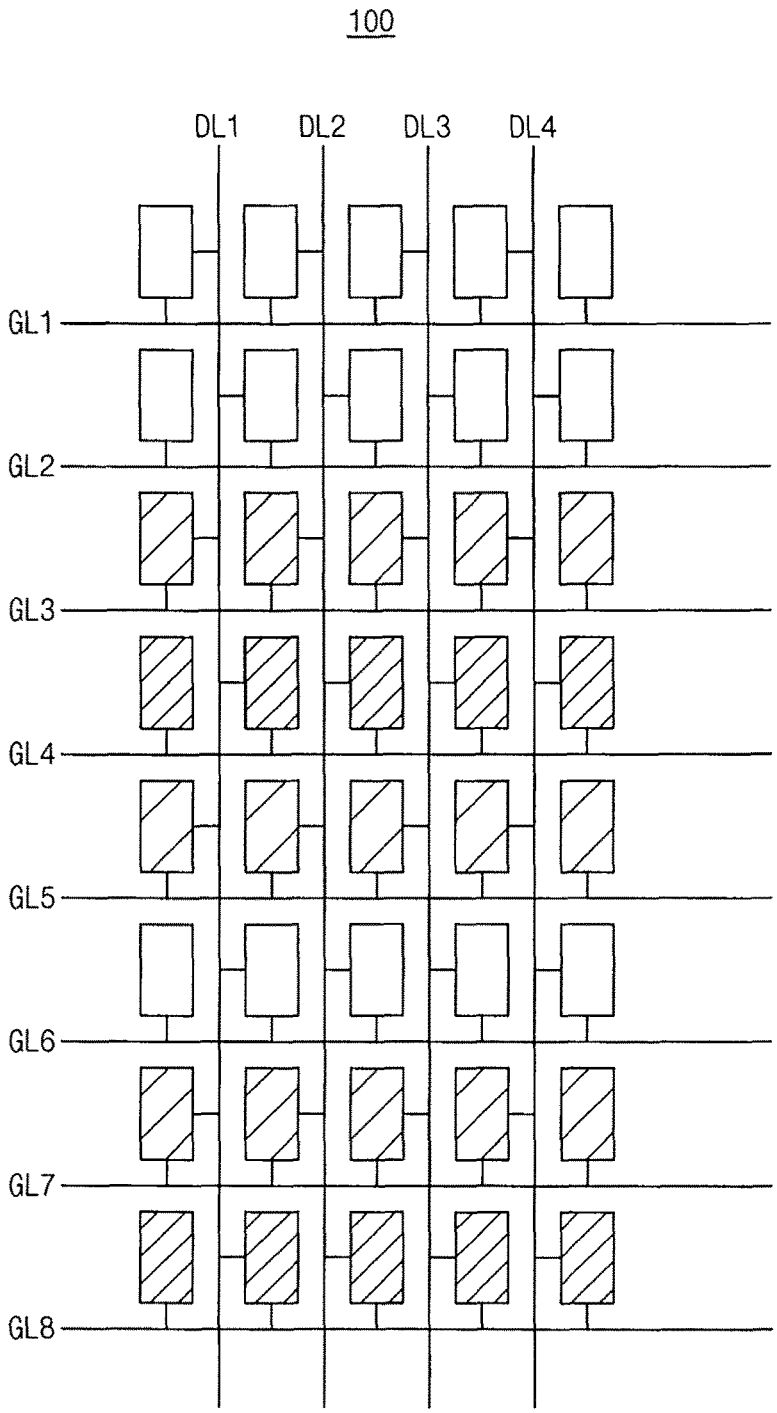
FIG. 6B is a diagram illustrating a second image pattern displayed on a display panel included in a display apparatus according to an exemplary embodiment of the present inventive concept.

FIG. 6B is a diagram illustrating a second image pattern displayed on a display panel included in a display apparatus according to an exemplary embodiment of the present inventive concept.

Referring to FIGS. 1, 2, 4B, 6A and 6B, the timing controller 200 may compare data corresponding to the fourth gate line GL4 with data corresponding to the second gate line GL2 and data corresponding to the third gate line GL3.

For example, pixels connected to the fourth gate line GL4 display an image, pixels connected to the third gate line GL3 display the image, and pixels connected to the second gate line GL2 do not display the image. For example, the data corresponding to the fourth gate line GL4 is closer to the data corresponding to the third gate line GL3 than to the data corresponding to the second gate line GL2.

The timing controller 200 may generate the selection signal SEL to select pulses (e.g., the first pulses PS1) outputted from the first shift register 310 for the fourth gate line GL4 based on the comparison.

The selector 340 may select pulses outputted from the first shift register 310 for the fourth gate line GL4 based on the selection signal SEL. The pulses outputted from the first shift register 310 may be generated based on the first vertical start signal STV1 and the gate clock signal CPV.

The gate driver 300 may generate a fourth gate signal (e.g., GS1_4) based on the selected pulses (e.g., the first pulses PS1). The fourth gate signal may have two high periods apart from each other by the first interval I1. For example, a rising edge of one of the two high periods may be apart from a rising edge of another one of the two high periods by a single horizontal period.

Substantially the same method may be applied to other gate lines.

Accordingly, pixels corresponding to second rows (e.g., fourth and eighth rows of the pixel matrix of FIG. 6B) of each of the first and second horizontal lines have a fourth brightness value. Referring to FIG. 6B, the fourth brightness value may be represented by five slashes. Pixels corresponding to first rows (e.g., third and seventh rows of the pixel matrix of FIG. 6B) of each of the first and second horizontal lines have a fifth brightness value. Referring to FIG. 6B, the fifth brightness value may be represented by three slashes.

Figure 7A:
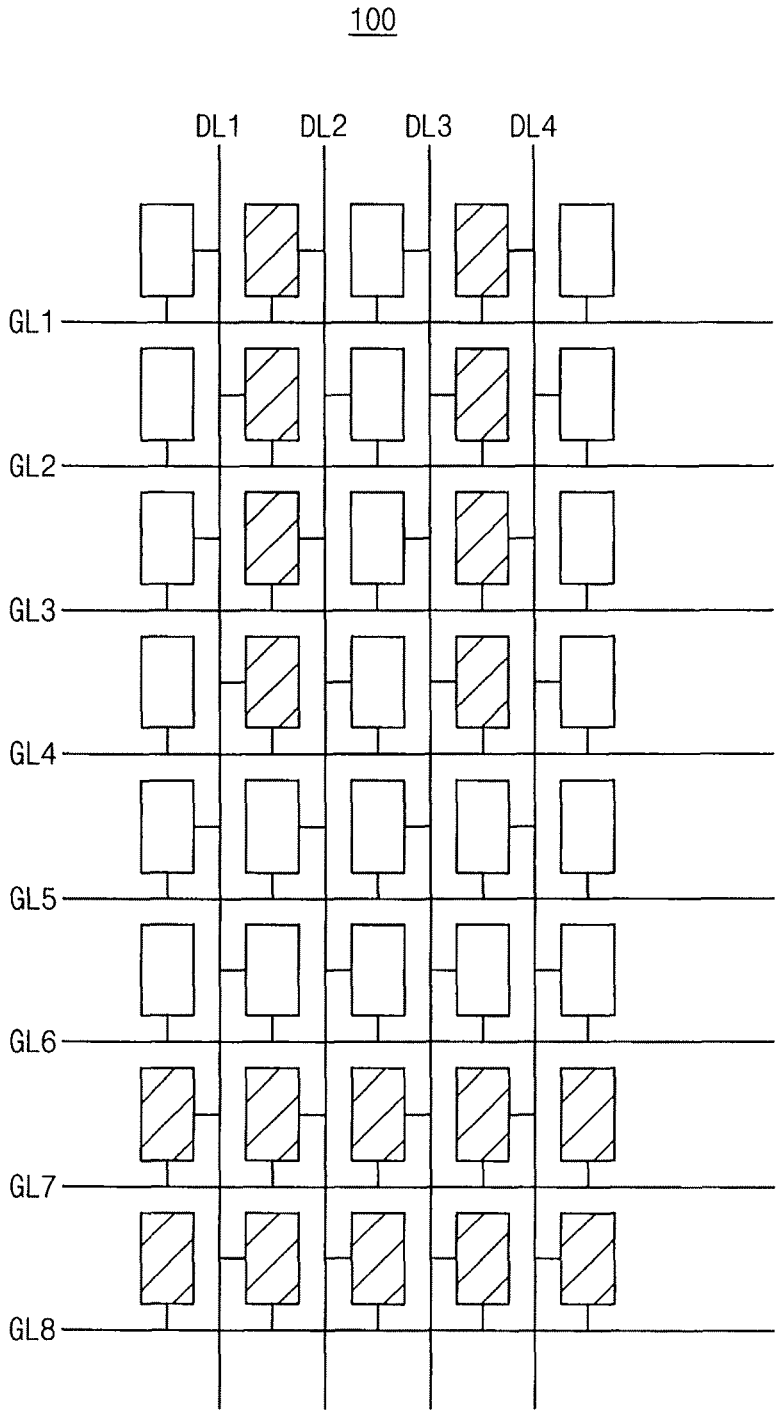
FIG. 7A is a diagram illustrating a third image pattern when pixels are not pre-charged.

FIG. 7A is a diagram illustrating a third image pattern when pixels are not pre-charged.

Referring to FIGS. 5A, 6A and 7A, a third image pattern includes the first and second image patterns.

An upper part of the third image pattern includes the first and second vertical lines. A lower part of the third image pattern includes the first and second horizontal lines. Pixels corresponding to the first and second vertical lines and the second horizontal line have a sixth brightness value when not pre-charged. Referring to FIG. 7A, the sixth brightness value may be represented by three slashes. For example, the sixth brightness value may be the same as the first brightness value or the fifth brightness value. In an exemplary embodiment of the present inventive concept, the sixth brightness value may be different from each of the first brightness value and the fifth brightness value.

Figure 7B:
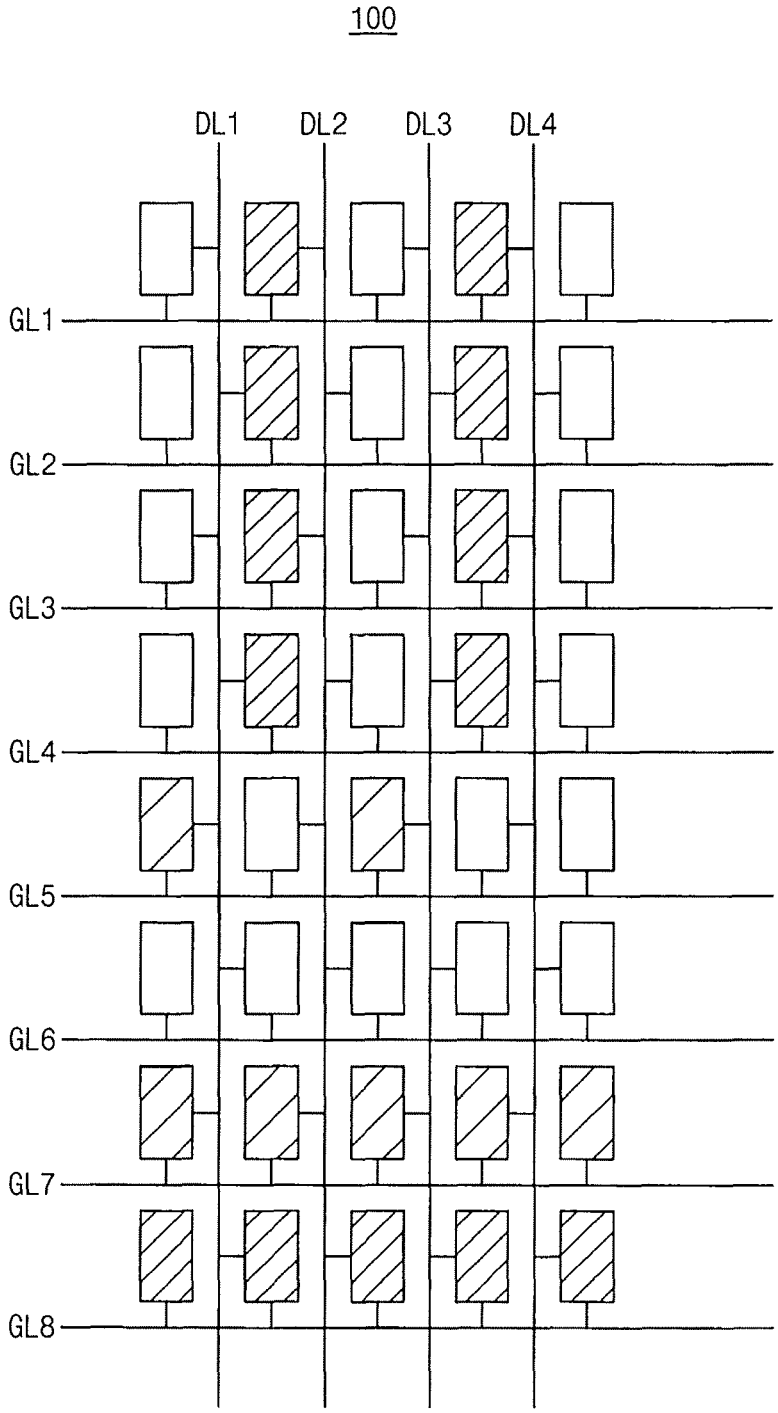
FIG. 7B is a diagram illustrating a third image pattern displayed on a display panel included in a display apparatus according to an exemplary embodiment of the present inventive concept.

FIG. 7B is a diagram illustrating a third image pattern displayed on a display panel included in a display apparatus according to an exemplary embodiment of the present inventive concept.

Referring to FIGS. 1, 2, 4D, 7A and 7B, the timing controller 200 may compare data corresponding to the third gate line GL3 with data corresponding to the first gate line GL1 and data corresponding to the second gate line GL2.

For example, among pixels connected to the first data line DL1, a pixel (e.g., a pixel in a third row and a first column of FIG. 7B) connected to the third gate line GL3 do not display an image, a pixel (e.g., a pixel in a second row and a second column of FIG. 7B) connected to the second gate line GL2 display the image, and a pixel (e.g., a pixel in a first row and the first column of FIG. 7B) connected to the first gate line GL1 do not display the image. For example, the data corresponding to the third gate line GL3 is closer to the data corresponding to the first gate line GL1 than to the data corresponding to the second gate line GL2.

The timing controller 200 may generate the selection signal SEL to select pulses (e.g., the second pulses PS2) outputted from the second shift register 320 for the third gate line GL3 based on the comparison.

The selector 340 may select the pulses outputted from the second shift register 320 for the third gate line GL3 based on the selection signal SEL. The pulses outputted from the second shift register 320 may be generated based on the second vertical start signal STV2 and the gate clock signal CPV.

The gate driver 300 may generate a third gate signal (e.g., GS2_3) based on the selected pulses (e.g., the second pulses PS2). The third gate signal may have two high periods apart from each other by the second interval I2. For example, a rising edge of one of the two high periods may be apart from a rising edge of another one of the two high periods by two horizontal periods.

In addition, the timing controller 200 may compare data corresponding to the eighth gate line GL8 with data corresponding to the sixth gate line GL6 and data corresponding to the seventh gate line GL7.

For example, a pixel (e.g., a pixel in an eighth row and the second column of FIG. 7B) connected to the eighth gate line GL8 display an image, a pixel (e.g., a pixel in a seventh row and the first column of FIG. 7B) connected to the seventh gate line GL7 display the image, and a pixel (e.g., a pixel in a sixth row and the second column of FIG. 7B) connected to the sixth gate line GL6 do not display the image. For example, the data corresponding to the eighth gate line GL8 is closer to the data corresponding to the seventh gate line GL7 than to the data corresponding to the sixth gate line GL6.

The timing controller 200 may generate the selection signal SEL to select pulses (e.g., the first pulses PS1) outputted from the first shift register 310 for the eighth gate line GL8 based on the comparison.

The selector 340 may select the pulses outputted from the first shift register 310 for the eighth gate line GL8 based on the selection signal SEL. The pulses outputted from the first shift register 310 may be generated based on the first vertical start signal STV1 and the gate clock signal CPV.

The gate driver 300 may generate a fourth gate signal (e.g., GS1_8) based on the selected pulses (e.g., the first pulses PS1) outputted from the first shift register 310. The fourth gate signal may have two high periods apart from each other by the first interval I1. For example, a rising edge of one of the two high periods may be apart from a rising edge of another one of the two high periods by a single horizontal period.

Substantially the same method may be applied to other gate lines.

Accordingly, pixels corresponding to the first and second vertical lines and a second row (e.g., an eighth row of FIG. 7B) of the second horizontal line have a seventh brightness value. Referring to FIG. 7B, the seven brightness value may be represented by five slashes. For example, the seventh brightness value may be the same as the second brightness value or the fourth brightness value. In an exemplary embodiment of the present inventive concept, the seventh brightness value may be different from each of the second brightness value and the fourth brightness value.

Figure 8:
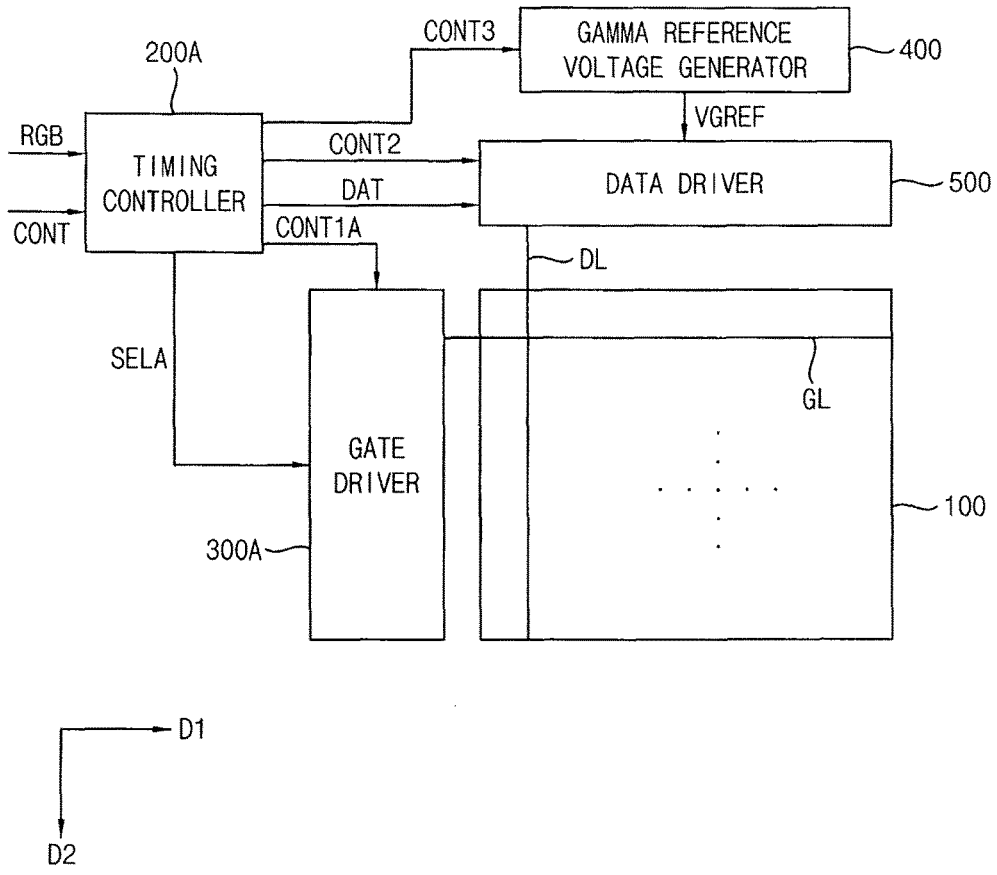
FIG. 8 is a block diagram illustrating a display apparatus according to an exemplary embodiment of the present inventive concept.

FIG. 8 is a block diagram illustrating a display apparatus according to an exemplary embodiment of the present inventive concept. Hereinafter, repetitive descriptions with respect to FIG. 1 will be omitted.

Referring to FIG. 8, the display apparatus includes a display panel 100 and a panel driver. The panel driver includes a timing controller 200A, a gate driver 300A, a gamma reference voltage generator 400 and a data driver 500.

The display panel 100 includes a plurality of gate lines GL, a plurality of data lines DL and a plurality of pixels, each of which is connected to one of the gate lines GL and one of the data lines DL. The gate lines GL extend in a first direction D1 and the data lines DL extend in a second direction D2 crossing the first direction D1.

The timing controller 200A generates a first control signal CONT1A, a second control signal CONT2, a third control signal CONT3, a data signal DAT and a selection signal SELA based on input image data RGB and an input control signal CONT.

The timing controller 200A generates the first control signal CONT1A for controlling operations of the gate driver 300A based on the input control signal CONT, and outputs the first control signal CONT1A to the gate driver 300A. The first control signal CONT1A may include a first vertical start signal and a gate clock signal. The first control signal CONT1A may further include second and third vertical start signals.

The vertical start signal will be described in detail with reference to FIGS. 10A and 10B.

The timing controller 200A generates the selection signal SELA for controlling operations of the gate driver 300A based on the input image data RGB. The timing controller 200A may compare data voltages respectively corresponding to each of the gate lines GL to generate the selection signal SELA. The timing controller 200A outputs the selection signal SELA to the gate driver 300A.

The selection signal SELA will be described in detail with reference to FIG. 9.

The gate driver 300A generates gate signals for driving the gate lines GL in response to the first control signal CONT1A and the selection signal SELA received from the timing controller 200A. The gate driver 300A sequentially outputs the gate signals to the gate lines GL.

The gate driver 300A will be described in detail with reference to FIG. 9.

Figure 9:
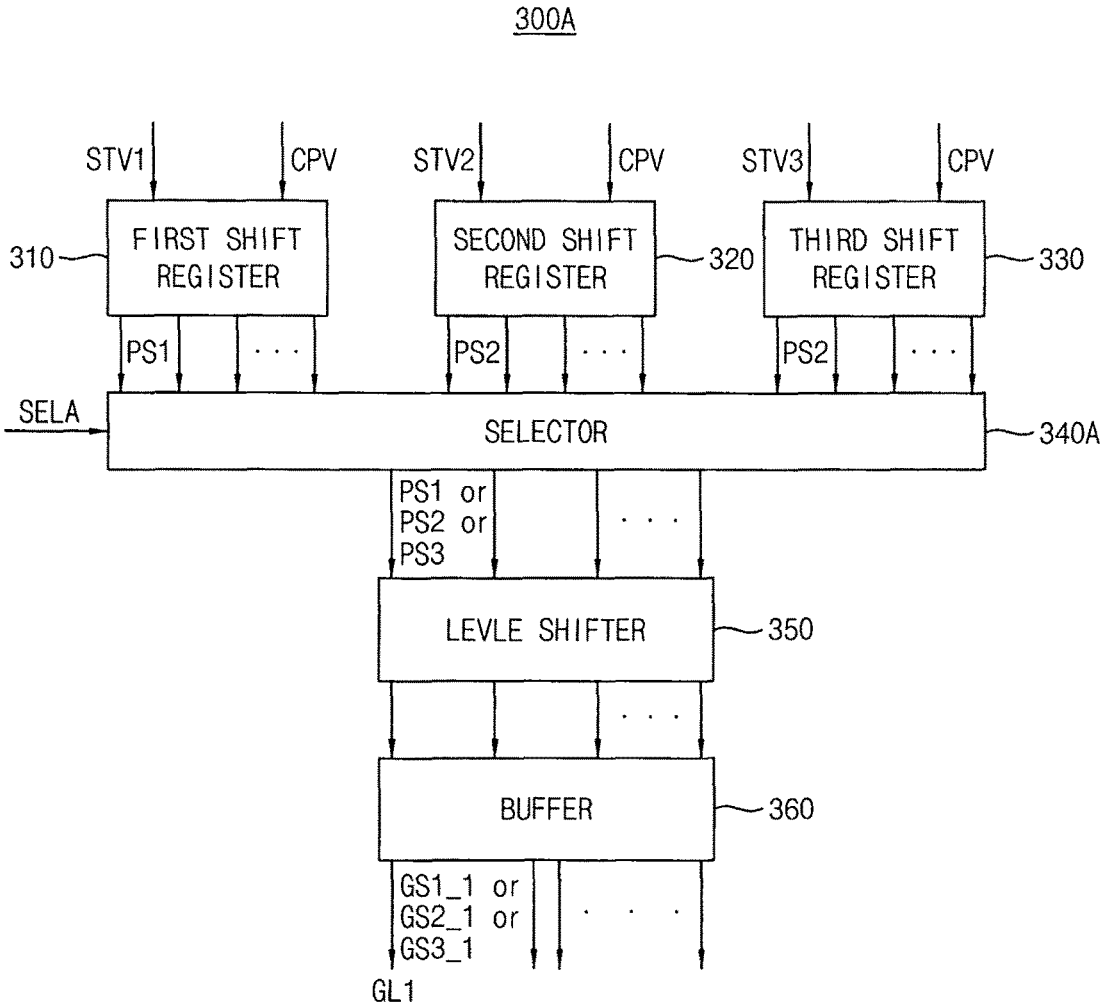
FIG. 9 is a block diagram illustrating a gate driver according to an exemplary embodiment of the present inventive concept.

FIG. 9 is a block diagram illustrating a gate driver according to an exemplary embodiment of the present inventive concept. Hereinafter, repetitive descriptions with respect to FIG. 2 will be omitted.

Referring to FIGS. 8 and 9, the gate driver 300A includes a first shift register 310, a second shift register 320, a third shift register 330 and a selector 340A. The gate driver 300A may further include a level shifter 350 and a buffer 360.

The first shift register 310 receives the first control signal CONT1A from the timing controller 200A. The first control signal CONT1A may include the first vertical start signal STV1 and a gate clock signal CPV. The first shift register 310 may generate a plurality of first pulses PS1 based on the first vertical start signal STV1 and the gate clock signal CPV. The first pulses PS1 may correspond to a first gate line GL1. The first shift register 310 outputs the first pulses PS1 to the selector 340A.

The second shift register 320 receives the first control signal CONT1A from the timing controller 200A. The first control signal CONT1A may include the second vertical start signal STV2 and the gate clock signal CPV. The second vertical start signal STV2 may be different from the first vertical start signal STV1. The second shift register 320 may generate a plurality of second pulses PS2 based on the second vertical start signal STV2 and the gate clock signal CPV. The second pulses PS2 may be different from the first pulses PS1. The second pulses PS2 may correspond to the first gate line GL1. The second shift register 320 outputs the second pulses PS2 to the selector 340A.

The third shift register 330 receives the first control signal CONT1A from the timing controller 200A. The first control signal CONT1A may include the third vertical start signal STV3 and the gate clock signal CPV. The third vertical start signal STV3 may be different from each of the first and second vertical start signals STV1 and STV2. The third shift register 330 may generate a plurality of third pulses PS3 based on the third vertical start signal STV3 and the gate clock signal CPV. The third pulses PS3 may be different from each of the first and second pulses PS1 and PS2. The third pulses PS3 may correspond to the first gate line GL1. The third shift register 330 outputs the third pulses PS3 to the selector 340A.

The first through third shift registers 310, 320, and 330 will be described in detail with reference to FIGS. 10A and 10B.

The selector 340A receives the selection signal SELA from the timing controller 200. The selector 340A receives the first pulses PS1 from the first shift register 310. The selector 340A receives the second pulses PS2 from the second shift register 320. The selector 340A receives the third pulses PS3 from the third shift register 330. The selector 340A selects one of the first pulses PS1, the second pulses PS2, and the third pulses PS3 for the first gate line GL1 based on the selection signal SELA. The selector 340A may output the selected one (e.g., PS1 or PS2 or PS3) of the first pulses PS1, the second pulses PS2 and the third pulses PS3 to the level shifter 350.

The level shifter 350 may amplify levels of the selected one (e.g., PS1 or PS2 or PS3) one (e.g., PS1 or PS2, PS3) of the first pulses PS1, the second pulses PS2 and the third pulses PS3. The level shifter 350 may output the amplified pulses to the buffer 360.

The buffer 360 may buffer the amplified pulses. The buffer 360 may further amplify the amplified pulses by an expected amount of reduction of gate voltage due to delay. The buffer 360 may output a first gate signal GS1_1 or GS2_1 or GS3_1 to the first gate line GL1.

Figure 10A:
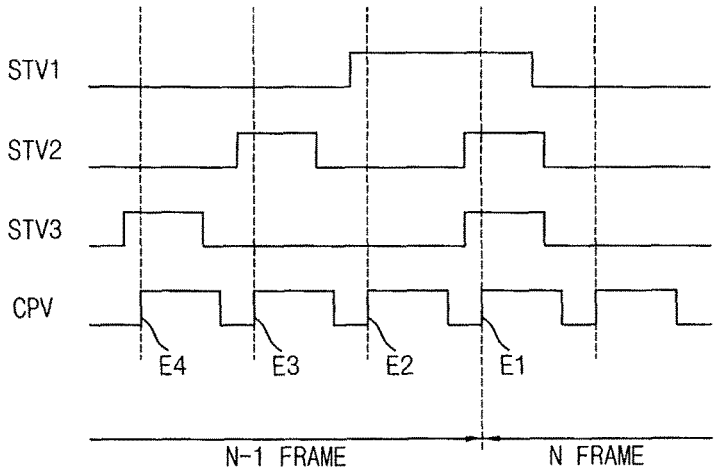
FIG. 10A is a diagram illustrating signals outputted to a gate driver according to an exemplary embodiment of the present inventive concept.

FIG. 10A is a diagram illustrating signals outputted to a gate driver according to an exemplary embodiment of the present inventive concept.

Referring to FIGS. 8, 9 and 10A, the timing controller 200A outputs the first control signal CONT1A to the gate driver 300A. The first control signal CONT1A may include the first vertical start signal STV1, the second vertical start signal STV2, the third vertical start signal STV3 and the gate clock signal CPV. The first, second and third vertical start signals STV1, STV2, and STV3 may be different from each other. The gate clock signal CPV may have a first transition time E1, a second transition time E2, a third transition time E3 and a fourth transition time E4.

The first vertical start signal STV1 may have a high level at the first and second transition times E1 and E2 of the gate clock signal CPV. The second vertical start signal STV2 may have the high level at the first and third transition times E1 and E3 of the gate clock signal CPV. The third vertical start signal STV3 may have the high level at the first and fourth transition times E1 and E4 of the gate clock signal CPV. The first and second transition times E1 and E2 may be adjacent to each other. The second and third transition times E2 and E3 may be adjacent to each other. The third and fourth transition times E3 and E4 may be adjacent to each other. For example, the first through fourth transition times E1 through E4 may be arranged in a sequential manner. Each of an interval between the first and second transition times E1 and E2, an interval between the second and third transition times E2 and E3, and an interval between the third and fourth transition times E3 and E4 may correspond to a single horizontal period.

Figure 10B:
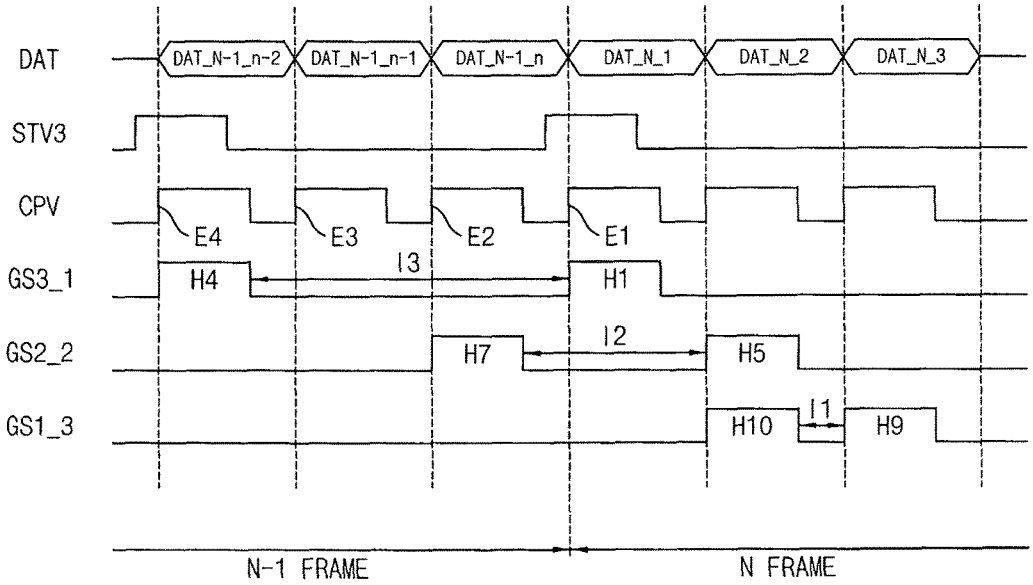
FIG. 10B is a diagram illustrating signals when a selector included in a gate driver, according to an exemplary embodiment of the present inventive concept, selects different pulses for each gate line.

FIG. 10B is a diagram illustrating signals when a selector included in a gate driver, according to an exemplary embodiment of the present inventive concept, selects different pulses for each gate line.

Referring to FIGS. 8, 9, 10A and 10B, the timing controller 200A may compare data DAT_N_1 corresponding to the first gate line GL1 in an N-th frame with data DAT_N−1_n−2 corresponding to an (n−2)-th gate line in an (N−1)-th frame, data DAT_N−1_n−1 corresponding to an (n−1)-th gate line in the (N−1)-th frame, and data DAT_N−1_n corresponding to an n-th gate line in the (N−1)-th frame.

When the data DAT_N_1 corresponding to the first gate line GL1 in the N-th frame is closer to the data DAT_N−1_n−2 corresponding to the (n−2)-th gate line in the (N−1)-th frame than each of the data DAT_N−1_n−1 corresponding to the (n−1)-th gate line in the (N−1)-th frame and the data DAT_N−1_n corresponding to an n-th gate line in the (N−1)-th frame, the timing controller 200A may generate the selection signal SELA to select the third pulses PS3 for the first gate line GL1.

The selector 340 may select the third pulses PS3 for the first gate line GL1 based on the selection signal SEL. The third pulses PS3 may be generated based on the third vertical start signal STV3 and the gate clock signal CPV.

The gate driver 300A may generate the first gate signal GS3_1 corresponding to the first gate line GL1. The first gate signal GS3_1 may have first and fourth high periods H1 and H4. The fourth high period H4 may be apart from the first high period H1 by a third interval I3. For example, a falling edge of the fourth high period H4 may be apart a rising edge of the first high period H1 by the third interval I3. The third interval I3 may be different from each of the first and second intervals I1 and I2. For example, a rising edge of the fourth high period H4 may be apart the rising edge of the first high period H1 by three horizontal periods. The data voltages DAT_N_1 corresponding to the first gate line GL1 in the N-th frame may be outputted during the first high period H1. The data voltages DAT_N−1_n−2 corresponding to the (n−2)-th gate line in the (N−1)-th frame may be outputted during the fourth high period H4.

Substantially the same method may be applied to the second and third gate signals (e.g., GS2_2 and GS_1_3).

The above-described embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

Although the present inventive concept has been shown and described with reference to exemplary embodiments thereof, it will be understood by those skilled in the art that various changes in forms and details may be made therein without departing from the spirit and scope of the present inventive concept as defined in the appended claims.

What is claimed is:

1. A gate driver comprising:

a first shift register configured to output a plurality of first pulses;

a second shift register configured to output a plurality of second pulses different from the plurality of first pulses; and a selector configured to select one of the plurality of first pulses or the plurality of second pulses, wherein when the selector selects the first pulses, the gate driver is configured to generate a first gate signal including a first high period and a second high period, and to output the first gate signal to a first gate line, the second high period being apart from the first high period by a first interval, and wherein when the selector selects the second pulses, the gate driver is configured to generate a second gate signal including the first high period and a third high period, and to output the second gate signal to the first gate line, the third high period being apart from the first high period by a second interval different from the first interval.

2. The gate driver of claim 1, wherein the first shift register is configured to generate the first pulses based on a gate clock signal and a first vertical start signal, and the second shift register is configured to generate the second pulses based on the gate clock signal and a second vertical start signal different from the first vertical start signal.

3. The gate driver of claim 2, wherein the first vertical start signal has high levels at a first transition time of the gate clock signal and a second transition time of the gate clock signal, and the second vertical start signal has the high levels at the first transition time of the gate clock signal and a third transition time of the gate clock signal.

4. The gate driver of claim 3, wherein the first and second transition times are adjacent to each other.

5. The gate driver of claim 4, wherein the second and third transition times are adjacent to each other.

6. The gate driver of claim 1, further comprising:

a level shifter configured to amplify the selected first pulses or second pulses; and a buffer configured to buffer the amplified first pulses to generate the first gate signal, or to buffer the amplified second pulses to generate the second gate signal.

7. The gate driver of claim 1, wherein the first shift register is configured to further output a plurality of third pulses, the second shift register is configured to further output a plurality of fourth pulses different from the plurality of third pulses, the selector is configured to further select one of the plurality of third pulses or the plurality of fourth pulses, wherein when the selector selects the third pulses, the gate driver is configured to further generate a third gate signal including a fourth high period and a fifth high period, and to output the third gate signal to a second gate line, the fifth high period being apart from the fourth high period by the first interval, and when the selector selects the fourth pulses, the gate driver is configured to further generate a fourth gate signal including the fourth high period and a sixth high period, and to output the fourth gate signal to the second gate line, the sixth high period being apart from the fourth high period by the second interval.

8. The gate driver of claim 7, wherein the selector selects the first pulses and the fourth pulses.

9. The gate driver of claim 1, further comprising:

a third shift register configured to output a plurality of third pulses different from each of the plurality of first pulses and the plurality of second pulses, wherein the selector is configured to select one of the plurality of first pulses, the plurality of second pulses, or the plurality of third pulses, and when the selector selects the third pulses, the gate driver is configured to generate a third gate signal including the first high period and a fourth high period, and to output the third gate signal to the first gate line, the fourth high period being apart from the first high period by a third interval different from each of the first and second intervals.

10. A display apparatus comprising:

a display panel comprising a first gate line;

a timing controller configured to generate a selection signal based on input image data;

a gate driver comprising:

a first shift register configured to output a plurality of first pulses;

a second shift register configured to output a plurality of second pulses different from the plurality of first pulses; and a selector configured to select one of the plurality of first pulses or the plurality of second pulses based on the selection signal; and a data driver configured to output a plurality of first data voltages corresponding to the first gate line, wherein when the selector selects the first pulses, the gate driver is configured to generate a first gate signal including a first high period and a second high period, and to output the first gate signal to the first gate line, the second high period being apart from the first high period by a first interval in a first direction, and when the selector selects the second pulses, the gate driver is configured to generate a second gate signal including the first high period and a third high period, and to output the second gate signal to the first gate line, the third high period being apart from the first high period by a second interval in the first direction, the second interval being different from the first interval.

11. The display apparatus of claim 10, wherein the timing controller is configured to further generate a gate clock signal, a first vertical start signal, and a second vertical start signal different from the first vertical start signal, the first shift register is configured to generate the first pulses based on the gate clock signal and the first vertical start signal, and the second shift register is configured to generate the second pulses based on the gate clock signal and the second vertical start signal.

12. The display apparatus of claim 11, wherein the first vertical start signal has high levels at a first transition time of the gate clock signal and a second transition time of the gate clock signal, and the second vertical start signal has the high levels at the first transition time of the gate clock signal and a third transition time of the gate clock signal.

13. The display apparatus of claim 12, wherein the first and second transition times are adjacent to each other, and the second and third transition times are adjacent to each other.

14. The display apparatus of claim 10, wherein the display panel further comprises second and third gate lines, the data driver is configured to output the first data voltages corresponding to the first gate line, second data voltages corresponding to the second gate line, and third data voltages corresponding to the third gate line in an order of the third data voltages, the second voltages, and the first data voltages, and the timing controller is configured to compare first data corresponding to the first gate line with each of second data corresponding to the second gate line and third data corresponding to the third gate line, and to generate the selection signal.

15. The display apparatus of claim 14, wherein when the first data is closer to the second data than to the third data, the selector is configured to select the first pulses based on the selection signal, and when the first data is closer to the third data than to the second data, the selector is configured to select the second pulses based on the selection signal.

16. The display apparatus of claim 15, wherein the first data voltages are outputted during the first high period, wherein when the first data is closer to the second data than to the third data and the selector selects the first pulses, the second data voltages are outputted during the second high period and the third data voltages are outputted during the third high period, wherein the second interval is two times the first interval.

17. The display apparatus of claim 10, wherein the gate driver further comprises:

a level shifter configured to amplify the selected first pulses or second pulses; and a buffer configured to buffer the amplified first pulses to generate the first gate signal, or buffer the amplified second pulses to generate the second gate signal.

18. The display apparatus of claim 10, wherein the display panel further comprises a second gate line, wherein the first shift register is configured to further output a plurality of third pulses, the second shift register is configured to further output a plurality of fourth pulses different from the plurality of third pulses, and the selector is configured to further select one of the plurality of third pulses or the plurality of fourth pulses based on the selection signal, wherein when the selector selects the third pulses, the gate driver is configured to further generate a third gate signal including a fourth high period and a fifth high period, and to output the third gate signal to the second gate line, the fifth high period being apart from the fourth high period by the first interval, and wherein when the selector selects the fourth pulses, the gate driver is configured to further generate a fourth gate signal including the fourth high period and a sixth high period, and to output the fourth gate signal to the second gate line, the sixth high period being apart from the fourth high period by the second interval.

19. The display apparatus of claim 18, wherein the selector selects the first pulses and the fourth pulses.

20. The display apparatus of claim 10, wherein the gate driver further comprises a third shift register configured to output a plurality of third pulses different from each of the plurality of first pulses and the plurality of second pulses, and the selector is configured to select one of the plurality of first pulses, the plurality of second pulses, or the plurality of third pulses, and wherein when the selector selects the third pulses, the gate driver is configured to generate a third gate signal including the first high period and a fourth high period, and to output the third gate signal to the first gate line, the fourth high period being apart from the first high period by a third interval different from each of the first and second intervals.

* * * * *